US012710195B1

(12) United States Patent
McEvoy et al.

(10) Patent No.: US 12,710,195 B1
(45) Date of Patent: Aug. 18, 2026

(54) FAN GUARD AND FAN GUARD ASSEMBLY

(71) Applicant: Cummins Power Generation Inc., Minneapolis, MN (US)

(72) Inventors: Joseph McEvoy, Peterborough (GB); Mark R Cartwright, Daventry (GB); Ian Fall, East Hunsbury (GB)

(73) Assignee: Cummins Power Generation Inc., Minneapolis, MN (US)

( * ) Notice: Subject to any disclaimer, the term of this patent is extended or adjusted under 35 U.S.C. 154(b) by 0 days.

(21) Appl. No.: 19/083,174

(22) Filed: Mar. 18, 2025

(51) Int. Cl.
*F24F 13/08* (2006.01)
*F04D 29/70* (2006.01)
*F04D 19/00* (2006.01)

(52) U.S. Cl.
CPC ..... *F24F 13/082* (2013.01); *F04D 29/703* (2013.01); *F04D 19/002* (2013.01)

(58) Field of Classification Search
CPC ..... F04D 29/703; F24F 13/20
See application file for complete search history.

(56) References Cited

U.S. PATENT DOCUMENTS 8,210,824 B1 * 7/2012 Bucher ..... F04D 19/002 416/214 R
2005/0271516 A1 * 12/2005 Chang ..... F04D 29/703 416/247 R

FOREIGN PATENT DOCUMENTS

CN 203308798 U * 11/2013
CN 108980117 A * 12/2018 ..... F04D 29/703
CN 211116843 U * 7/2020
CN 112145484 A * 12/2020 ..... F04D 29/703
CN 213451048 U * 6/2021

OTHER PUBLICATIONS

Cummins Inc., Generator Set Data Sheet, Model DQLH, D-3542, Sep. 2017.
IEA LLC, "Installation, Operation and Maintenance Manual for Engine Mounted Radiators with Extended Shafts," Doc. No. 8408247, Jan. 2014.
IEC LLC, "Installation, Operation and Maintenance Manual for All Standard Radiator Models," Doc. No. 8401523, Aug. 2020.

* cited by examiner

*Primary Examiner* — Eldon T Brockman
(74) *Attorney, Agent, or Firm* — Foley & Lardner LLP

(57) ABSTRACT

A fan guard includes a plurality of first panels radially extending from a center of the fan guard. At least one of the first panels includes a first panel first end and a first panel second end. The first panel first end of one of the first panels fixedly coupled to the first panel second end of another of the first panels. The fan guard includes a second panel radially extending from the center of the fan guard. The second panel includes a second panel first end and a second panel second end. The second panel first end is positioned next to the first panel second end of one of the first panels such that a gap is present between the one of the first panels and the second panel. The second panel second end is fixedly coupled to the first panel first end of another one of the first panels and the first panels and the second panel include a plurality of openings.

17 Claims, 8 Drawing Sheets

FAN GUARD AND FAN GUARD ASSEMBLY

TECHNICAL FIELD

The present application relates generally to a fan guard for use with a radiator.

BACKGROUND

Fan guards can couple to a radiator and fan assembly to provide protection for the radiator, fan, and externally (e.g., to protect elements in the external environment, such as nearby personnel and/or objects, from the fan itself). Parts of fan guards can experience fatigue, vibrations, or stress.

SUMMARY

Various embodiments relate to a fan guard. The fan guard can include a plurality of first panels radially extending from a center of the fan guard. At least one of the first panels can include a first panel first end and a first panel second end. The first panel first end of one of the first panels can be fixedly coupled to the first panel second end of another of the first panels. The fan guard can include a second panel radially extending from the center of the fan guard. The second panel can include a second panel first end and a second panel second end. The second panel first end can be positioned next to the first panel second end of one of the first panels such that a gap can be present between the one of the first panels and the second panel. The second panel second end can be fixedly coupled to the first panel first end of another one of the first panels and the first panels and the second panel include a plurality of openings.

Various embodiments relate to a fan guard. The fan guard can include a plurality of panels radially extending from a center of the fan guard. At least one of the panels can include a first end and a second end. The first end can include a first flange extending in a first direction orthogonal to a plane of the panels and the second end can include a second flange extending in the first direction. The panels can include a plurality of openings extending through the panels and the openings arranged radially in rows. The first flange of one of the panels can be positioned next to the second flange of an adjacent panel such that a gap exists between the two panels. The first flange of the remaining panels are fixedly coupled to the second flange of an adjacent panel.

Various embodiments relate to a method. The method can include coupling a first panel to a second panel by coupling a first end of the first panel to a second end of the second panel. The first panel and the second panel radially extend from an end. The method can include coupling a third panel to the first panel by coupling a second end of the first panel to a first end of the third panel. The method can include positioning a first end of a fourth panel next to a second end of the third panel such that a gap exists between the fourth panel and the third panel. The method can include coupling a fifth panel to the fourth panel by coupling a first end of the fifth panel to a second end of the fourth panel.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

It will be recognized that the Figures are schematic representations for purposes of illustration. The Figures are provided for the purpose of illustrating one or more implementations with the explicit understanding that the Figures will not be used to limit the scope or the meaning of the claims.

DETAILED DESCRIPTION

Following below are more detailed descriptions of various concepts related to, and implementations of, methods, apparatuses, and systems for a fan guard and a fan guard assembly. The various concepts introduced above and discussed in greater detail below may be implemented in any of a number of ways, as the described concepts are not limited to any particular manner of implementation. Examples of specific implementations and applications are provided primarily for illustrative purposes.

The present disclosure provides for fan guard with enhancements to mitigate against fatigue and failure. In particular, exemplary fan guards according to the present disclosure can reduce vibrations associated with motion on the fan guard from a radiator that can lead to an increase of shift resonant frequencies. Exemplary fan guards according to the present disclosure can experience reduced stresses, fatigue, and vibrations.

Figure 1:
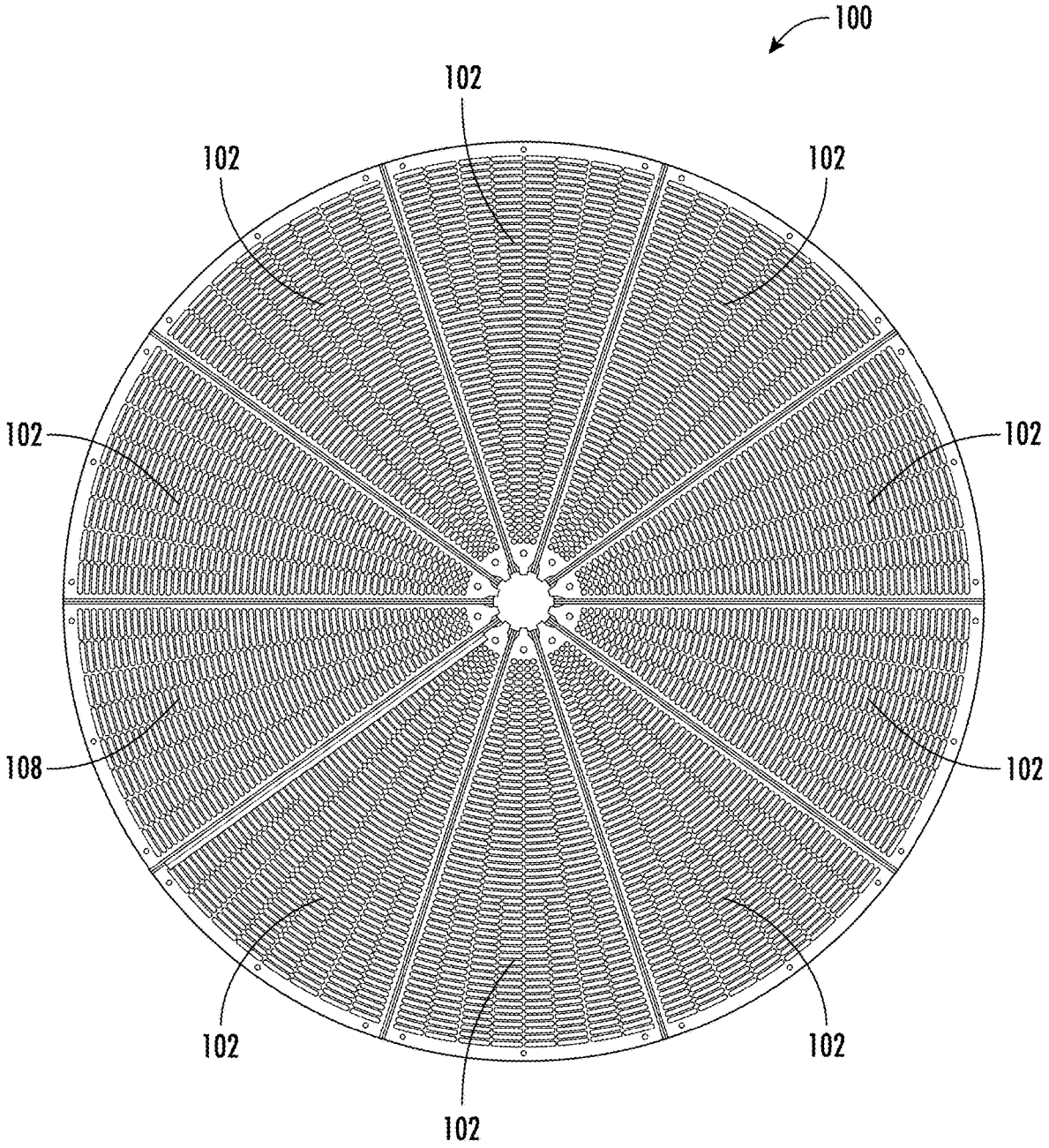
FIG. 1 is a front view of an exemplary fan guard.
Figure 2:
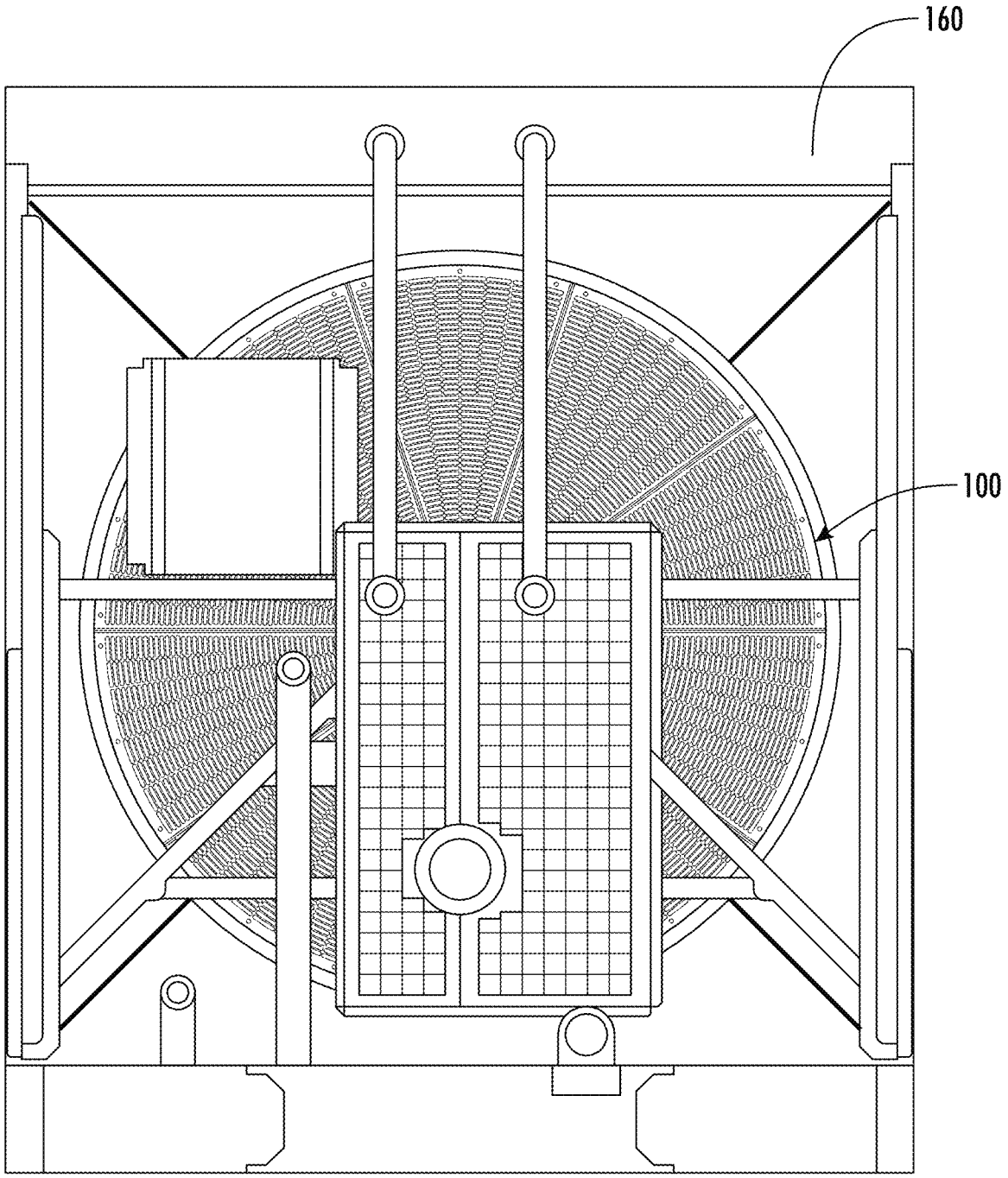
FIG. 2 is a back view of an exemplary fan guard coupled with a radiator.

FIGS. 1 and 2, among others, depict a fan guard 100. The fan guard 100 can be a part of a radiator and/or cooling system. For example, the fan guard 100 can be fitted on a radiator to ensure proper operation of the radiator. The fan guard 100 is configured to protect the radiator from external objects and an external environment. Although fan guards can degrade airflow of the radiator, the configuration of the fan guard 100, including the openings in the fan guard 100 and overall shape of the fan guard 100, etc., can help minimize degradation of airflow, ensuring proper airflow of the radiator, while providing adequate protection for the radiator and externally.

As illustrated in FIGS. 1-5, the fan guard 100 includes a plurality of first panels 102. The first panels 102 can extend radially from a center of the fan guard 100. The first panels 102 can be manufactured from steel (e.g., carbon steel), among others. The first panels 102 can have varying thickness values. For example, the first panels 102 can be manufactured from 10-gauge steel or 11-gauge steel. Other materials can be used. At least one of the first panels 102 includes a first panel first end 104 and a first panel second end 106. In various embodiments, each of the first panels 102 includes a first panel first end 104 and a first panel second end 106. The first panel first end 104 and the first panel second end 106 can be positioned on a side opposite of each other.

Figure 3:
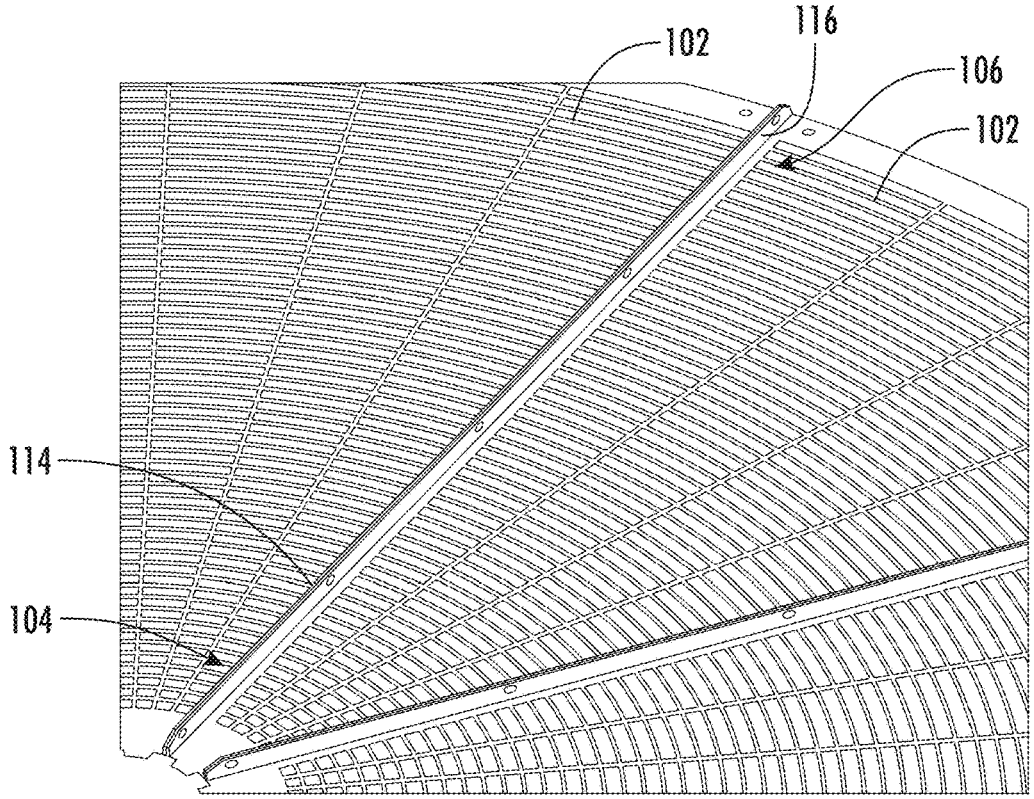
FIG. 3 is a partial view of panels of an exemplary fan guard.

As illustrated in FIGS. 1 and 3, the first panels 102 can couple to each other. For example, the first panels 102 can couple to each other by the first panel first end 104 and the first panel second end 106. The first panel first end 104 of one of the first panels 102 can fixedly couple to the first panel second end 106 of another of the first panels 102. In various embodiments, the first panels 102 are fixedly coupled with mechanical fasteners (e.g., bolts, screws, nails, etc.). Fixedly coupling the first panels 102 allows for a secure fan guard 100 during use. The first panels 102 can be coupled to one another by the first panel first end 104 and the first panel second end 106 to form, at least in part, an enclosed structure.

The fan guard 100 also includes a second panel 108. The second panel 108 extends radially from the center of the fan guard 100. In various embodiments, the second panel 108 and the first panels 102 extend radially from the center of the fan guard 100 at a same distance such that second panel 108 has substantially a same size as the first panels 102. In some embodiments, the second panel 108 may differ in size from the first panels 102.

Although fixedly coupling the first panels 102 allows for a secure and stable fan guard 100, the coupling of the first panels 102 can lead to stress on the fan guard 100. For example, assembly stress can occur as the first panels 102 are fixedly coupled. The configuration of the second panel 108 allows for such stress to be alleviated and thereby lessen potential fatigue. The second panel 108 includes a second panel first end 110 and a second panel second end 112. The second panel first end 110 is positioned next to the first panel first end 104 of one of the first panels 102 such that a gap is present between the one of the first panels 102 and the second panel 108.

The second panel 108 and the gap functions to alleviate the assembly stress of fixedly coupling the first panels 102. This can ensure that there is an appropriate tolerance for components. For example, in an assembly of a fan guard without the second panel 108, when coupling the last panel, the last panel may not fit into the fan guard if the configuration is out of tolerance. As such, the last panel would instead serve as a wedge and compress the remaining panels resulting in the assembly stress. According to the embodiments of the present disclosure, the gap can alleviate assembly stress by allowing for the panels not to require a specific tolerance. In particular, the gap can allow for a greater variation in tolerance during assembly. The gap can vary dependent on the coupling of the remaining first panels 102 in order to alleviate the assembly stress. For example, the gap can vary between 0% and 0.25% of a diameter of the fan guard 100. In such examples, the diameter of the fan guard 100 can increase by up to 0.25% (with the gap) to allow for tolerance stack up. In various embodiments, the gap is absent or is of a negligible size (so as to effectively be absent), such that there is no distance between the second panel 108 and the one of the first panels 102. Thus, the second panel 108 and the one of the first panels 102 can be substantially flush with each other.

The second panel second end 112 can be fixedly coupled to the first panel first end 110 of another one of the first panels 102. The coupling of the first panels 102 and the second panel 108 forms a fully enclosed structure. In various embodiments, the first panels 102 and the second panel 108 have an end. The end is coupled to the respective first end and the respective second end of the first panels 102 and the second panel 108. In various embodiments, the end of the first panels 102 and the second panel 108 are curved in profile. For example, the coupled first panels 102 and second panel 108 can form a substantially circular shape. The circular shape of the fan guard 100 can aid in reducing stress as there is a reduction in sharp corners. In various embodiments, the end of the first panels 102 and the second panel 108 are linear in profile.

In various embodiments, as shown in FIG. 1, a total number of first panels 102 and second panel 108 is an even number. For example, the total number of first panels 102 and second panel 108 can be ten (10). In some embodiments, an odd number of the first panels 102 can be provided. An increase in the total number of first panels 102 and second panel 108 can add stiffness to the fan guard 100. Adding stiffness can shift resonance frequencies and reduce vibrations according to various embodiments. The number of panels may be limited so as to not impede airflow from the radiator through the fan guard 100.

In various embodiments, the second panel 108 is the same type as the first panels 102 such that the fan guard 100 includes a plurality of panels of the same type. In such embodiments, the plurality of panels include the first panel first end 104 and the first panel second end 106. The first panel first end 104 of one of the panels is positioned next to the first panel second end 106 of an adjacent panel such that the gap exists. The first panel first end 104 of the remaining panels are fixedly coupled to the first panel second end 106 of an adjacent panel. Such configuration allows for a reduction in manufacturing, by avoiding the need to manufacture a separate component for the second panel 108, therefore increasing ease in production, among other benefits.

Figure 5:
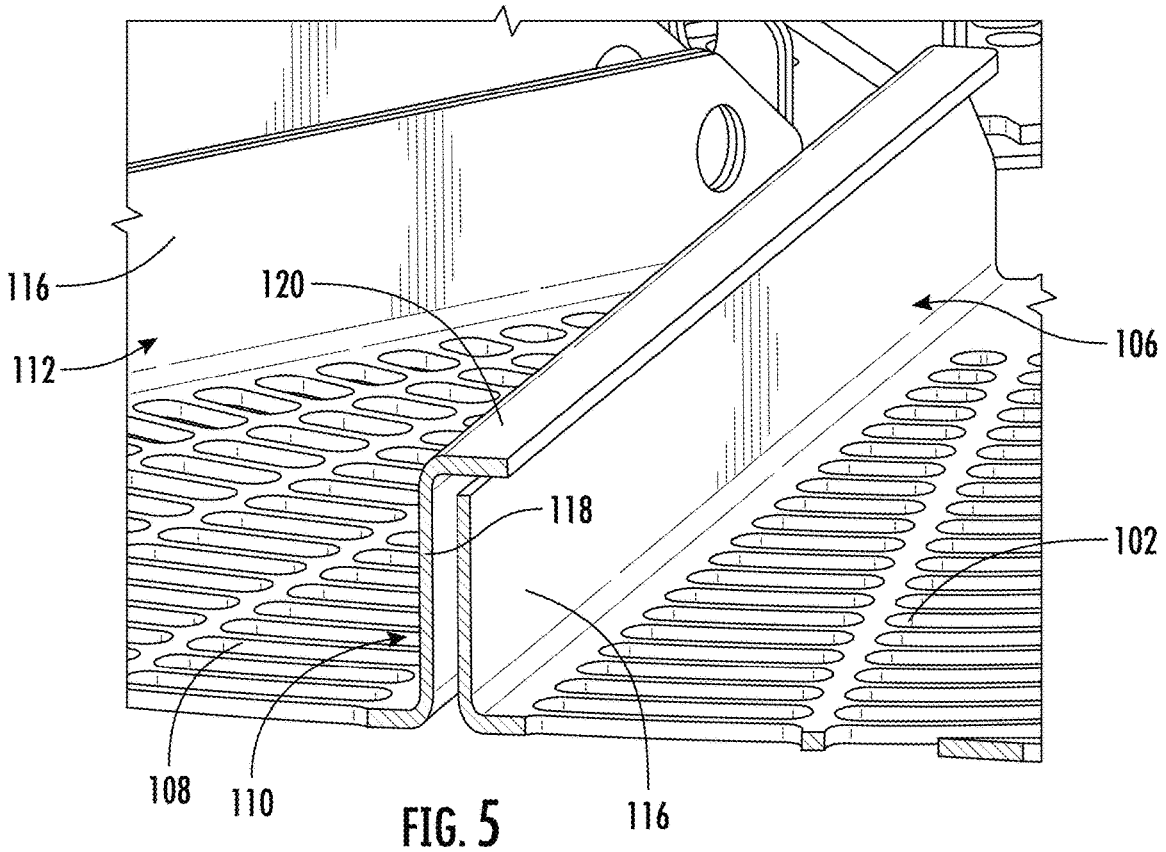
FIG. 5 depicts adjacent panels of an exemplary fan guard.

As illustrated in FIG. 3, the first panels 102 can include flanges. The first panel first end 104 can include a first flange 114 and the first panel second end 106 can include a second flange 116. In various embodiments, the first flange 114 and the second flange 116 have the same configuration. The first flange 114 and the second flange 116 can extend in a direction orthogonal to a plane of the first panels 102. The first panels 102 can be fixedly coupled to the first panels 102 and to the second panels by the first flange 114 and the second flange 116. In various embodiments, the first flange 114 and the second flange 116 includes holes (apertures, openings). For example, the holes can be used to pass a mechanical fastener through and fixedly couple the panels together. In various embodiments, as illustrated in FIG. 5, the second flange 116 of the first panel 102 positioned next to the second panel first end 110 of the second panel 108 can omit holes. The elimination of holes for that second flange 116 can reduce manufacturing as the panels are not being fixedly coupled, but rather positioned next to each other.

As illustrated in FIG. 5, the second panel 108 includes a third flange 118 positioned at the second panel first end 110. The third flange 118 and the second flange 116 of one of the first panels 102 forms the gap between the panels. In various embodiments, the third flange 118 includes a bent portion 120. The bent portion 120 provides a clearance allows for the gap between the second panel 108 and the one of the first panels 102 to vary, as described herein. The second panel 108 also includes a flange on the second panel second end 112. In various embodiments, the flange is the second flange 116 such that the second flange 116 is fixedly coupled to the first flange 114 of one of the first panels 102 to fixedly couple the panels together.

The first flange 114, the second flange 116, and the third flange 118 also increase stiffness of the fan guard 100. The extending of the flanges from the panels provides more support for the fan guard 100, therefore aiding in stiffening the panels, and overall, the fan guard 100. The increase stiffness of the fan guard 100 aids in reducing the vibrations and potential damage of the fan guard 100.

As illustrated in FIGS. 1-8, the first panels 102 and the second panel 108 also include a plurality of openings 122. The openings 122 are configured to allow air flow from the radiator and through the fan guard 100. The openings 122 extend through the panels in a direction orthogonal to the plane of the panels. In various embodiments, the openings 122 has sharp corners or edges. For example, the openings 122 may be rectangular or a square-shaped, among other shapes. Openings 122 with sharp corners/edges can have increased turbulence at the edges from the air flow of the radiator in comparison to openings 122 with a rounder (e.g., annular) edge. In various embodiments, the openings 122 are annular. For example, the openings 122 can be circular, ovoid, elliptical, etc. The configuration of the openings 122 having rounded shapes can reduce associated stresses. In comparison to openings 122 with sharp corners (e.g., rectangular, brick pattern, etc.), the annular shape of the openings 122 can reduce so-called "hot spot" stresses and distribute the stress concentration on the fan guard 100.

Figure 7:
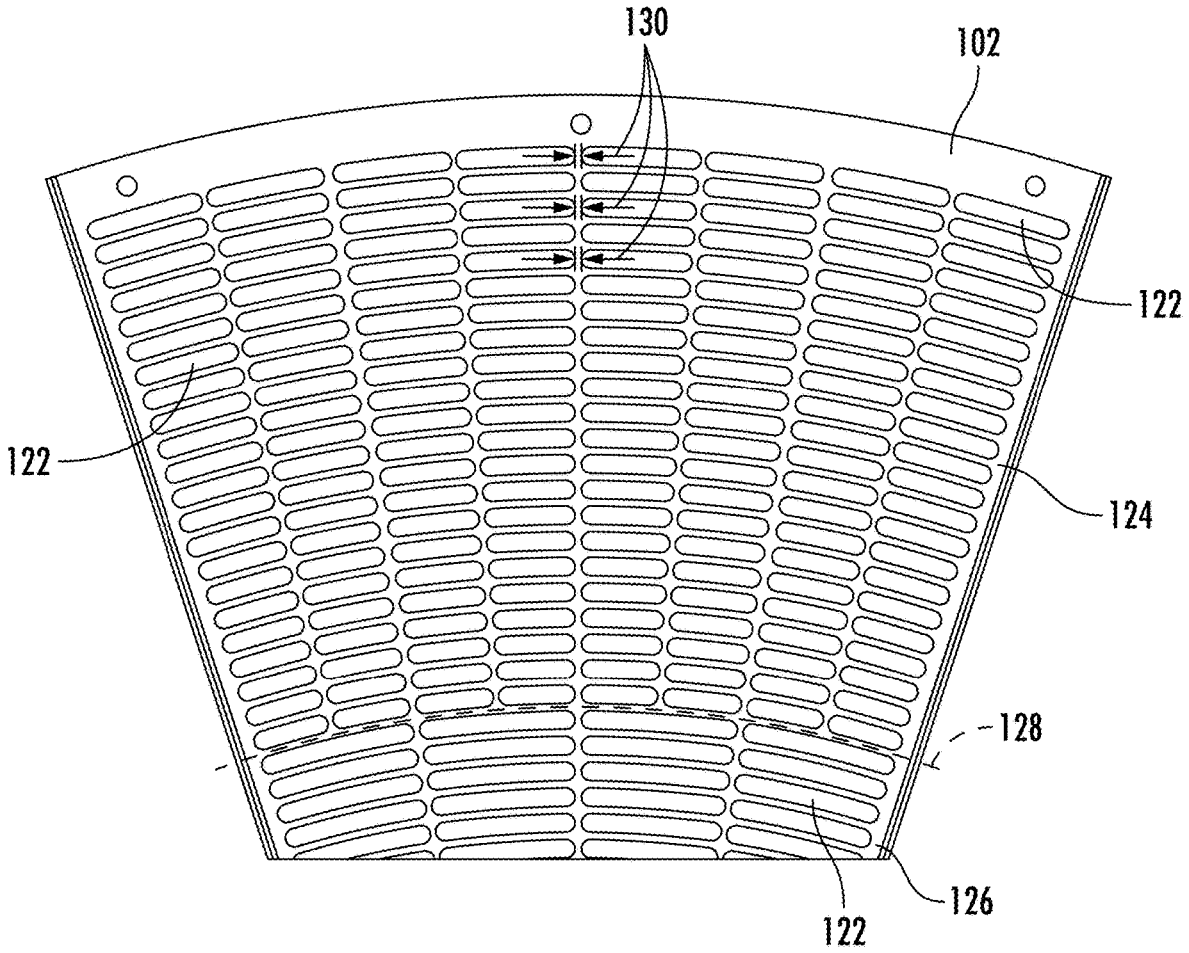
FIG. 7 is a front view of a portion of a panel of an exemplary fan guard.
Figure 8:
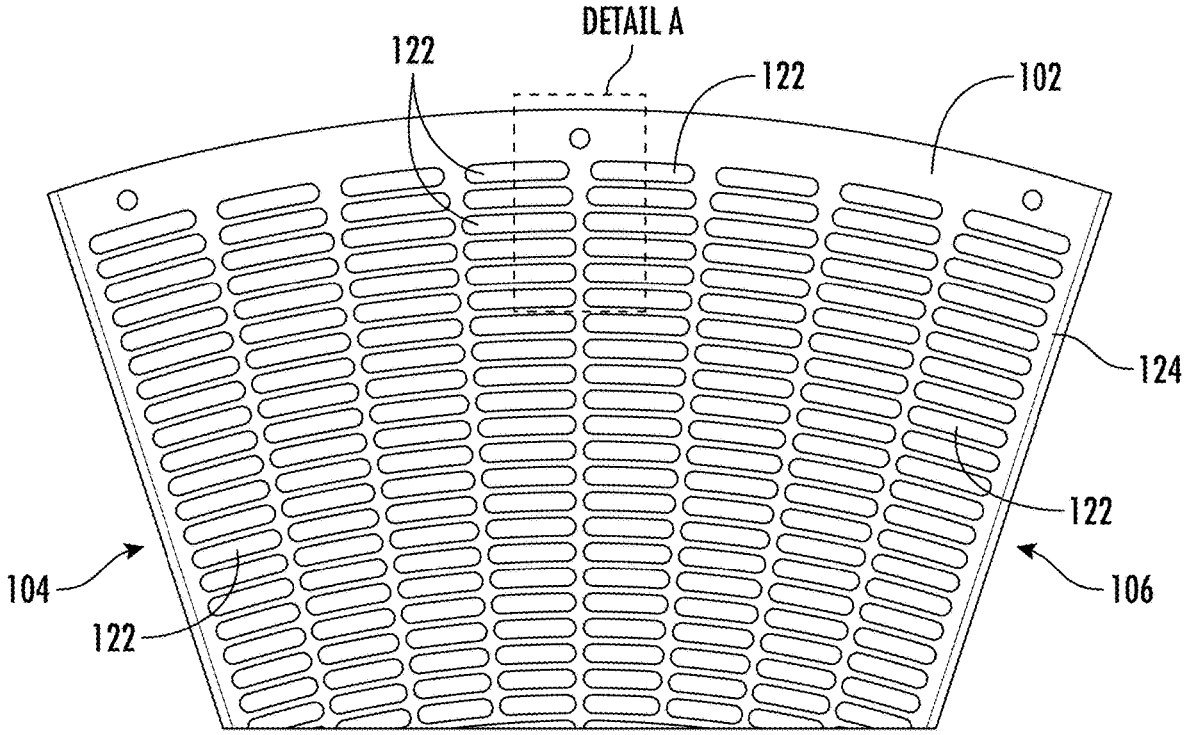
FIG. 8 is a front view of a portion of a panel of an exemplary fan guard.
Figure 9:
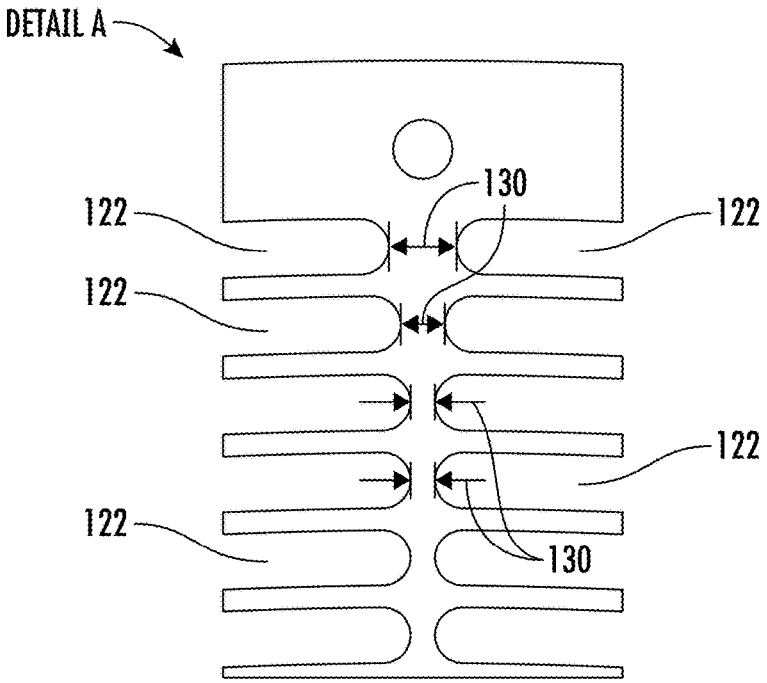
FIG. 9 is a view of Detail A in FIG. 8.

The openings 122 can be arranged in a number of configurations. For example, the openings 122 can be arranged radially along rows as is illustrated in FIGS. 7 and 8. The openings 122 can be spaced apart from adjacent openings 122 by a predetermined distance 130. In various embodiments, as illustrated in FIG. 7, the predetermined distance 130 is a same value for all the openings 122 along the rows. In various embodiments the predetermined distance 130 varies dependent on a row of the openings 122. For example, the predetermined distance 130 can be greater for rows further away from the center of the fan guard 100, as is shown in FIGS. 8 and 9. For a first row of the openings 122, with the first row having a greatest distance from the center of the fan guard 100, the predetermined distance 130 is greater than a subsequent second row of the openings 122, with the second row have a smaller distance from the center of the fan guard 100 than the first row. In various embodiments, the first row and the second row have predetermined distances less than the predetermined distances 130 of the remaining rows of the openings 122. In other words, the predetermined distance 130 may be greater for the first row and then reduce as the rows become closer to the center of the fan guard 100. The varying of the predetermined distance 130 aids in reducing stress in areas further from the center of the fan guard 100. Relatively higher bending stress can be present farther away from the center of the fan guard 100 (e.g., the first row and the second row of the openings 122) and decrease in rows closer to the center. The tapering of the predetermined distance 130 can reduce the stress at the first row and the second row, therefore allowing for stress to be more evenly disturbed across the fan guard 100.

The first panels 102 and the second panel 108 include a top half 124 and a bottom half 126 defined by a center 128 of the panels. The bottom half 126 is closer to the center of the fan guard 100 than the top half 124. The top half 124 and the bottom half 126 include the openings 122. In various embodiments, as is illustrated in FIGS. 1 and 7, the top half 124 includes a greater number of openings 122 than the bottom half 126. For example, the top half 124 can include double a number of openings in the bottom half 126. In order to accommodate the increase of openings 122 in the top half 124, the openings 122 in the top half 124 may have a smaller width than the openings 122 in the bottom half 126. The change in the number of openings 122 between the top half 124 and the bottom half 126 can aid in optimizing airflow and stiffness. For example, a larger opening 122 may result in greater airflow; however, the larger opening 122 may be less stiff. To reduce vibration of the openings 122 farther away from the center of the fan guard 100 while providing sufficient airflow, a greater number of openings are in the top half 124.

Figure 4:
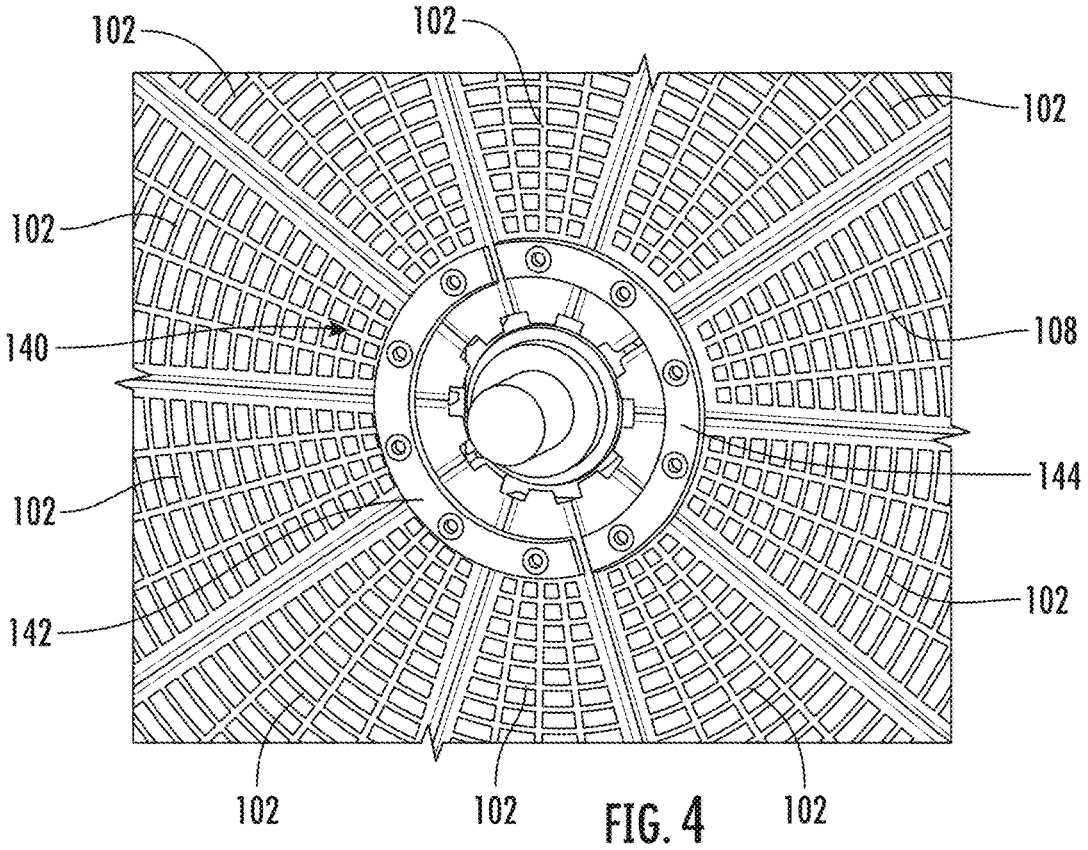
FIG. 4 is a detail view of a ring of an exemplary fan guard.

As illustrated in FIG. 4, the fan guard 100 can also include a ring 140. The ring 140 can be proximate the center of the fan guard 100. The ring 140 can be coupled to the first panels 102 and the second panel 108. During assembly and disassembly of the fan guard 100, the ring 140 can be coupled and uncoupled, respectively, from the panels. The ring 140 increases stability of the first panels 102 and the second panel 108 on the fan guard 100, therefore resulting in an increase in stiffness. As described herein, the increase of stiffness results in shifted resonance frequencies and fewer vibrations on the fan guard 100 to reduce potential damage to the fan guard 100.

In various embodiments, for servicing of the radiator or any components covered by the fan guard 100, the fan will have to be removed in order to remove the fan guard 100. This is due to the ring 140 coupling to components (e.g., a long shaft connected to the cooling system) of the fan such that assembly/disassembly of the ring 140 requires the fan to be uncoupled from the system (e.g., an engine of the system). As illustrated in FIG. 4, the ring 140 can include a first ring portion 142 and a second ring portion 144. In various embodiments, the first ring portion 142 is coupled to one or more of the panels (e.g., the first panels 102, the second panel 108) and the second ring portion 144 is coupled to another of the panels (e.g., the first panels 102, the second panel 108). Splitting or dividing the ring 140 into the first ring portion 142 and the second ring portion 144 can provide ease in assembly and disassembly (e.g., for service) of the fan guard 100. For example, when the ring 140 is not split into the first ring portion 142 and the second ring portion 144, as described herein the fan would have to be removed from an engine and then the ring 140 is coupled to the fan. However, with the first ring portion 142 and the second ring portion 144, the first ring portion 142 can be fitted onto the fan while the fan is connected to the engine and subsequentially, the second ring portion 144 can be fitted onto the fan.

Figure 6:
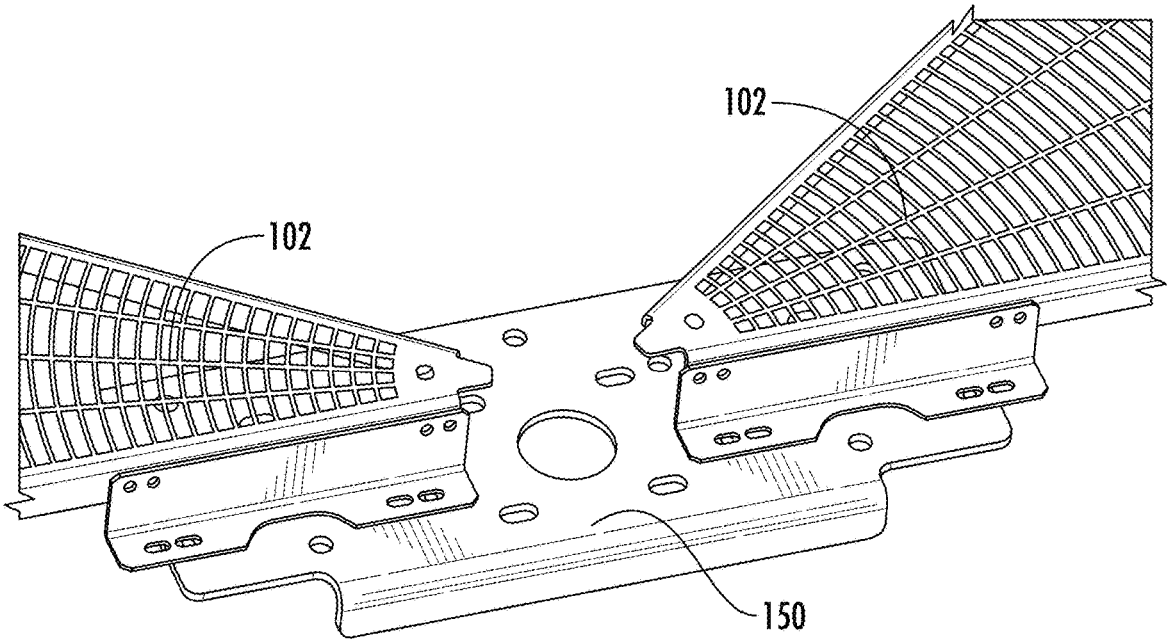
FIG. 6 depicts a stabilizer of an exemplary fan guard.

As illustrated in FIG. 6, the fan guard 100 can also include a stabilizer bracket 150. The stabilizer bracket 150 is coupled to two of the panels. The two panels can be positioned opposite of one another. In various embodiments, the two panels include flanges that can couple to the stabilizer bracket 150. The stabilizer bracket 150 is configured to further stabilize the panels, resulting in a stiffer fan guard 100.

Figure 10:
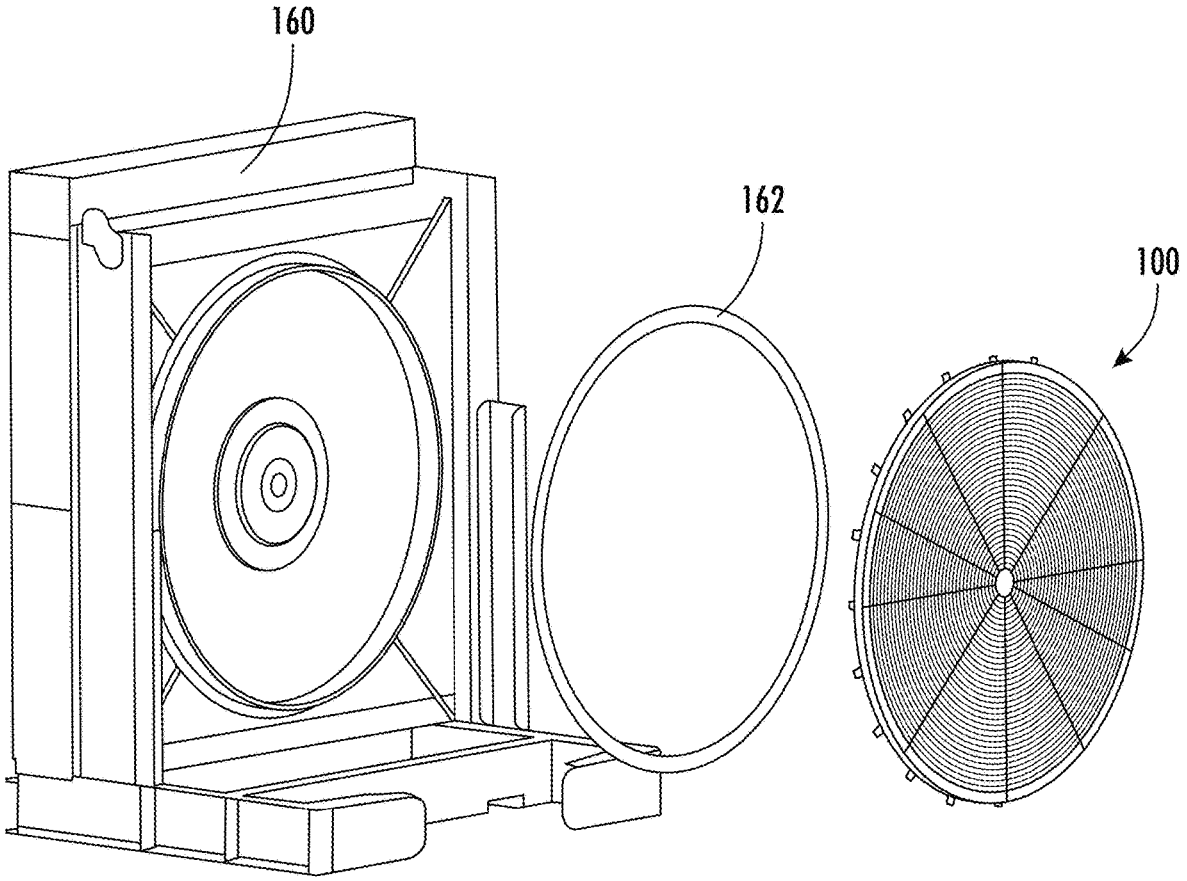
FIG. 10 shows an exploded view of an exemplary fan guard and a radiator.

As described herein, and illustrated in FIGS. 2 and 10, the fan guard 100 and the first panels 102 and the second panel 108 can couple to a radiator 160. In various embodiments, the fan guard 100 is coupled to the radiator 160 by a fan shroud 162. The fan shroud 162 can fit on the radiator and aid in channeling air through the fan guard 100. In various embodiments, the fan shroud 162 is manufactured from plastic or metal. The fan shroud 162 includes an opening complementary in profile to a profile of the coupled first panels 102 and second panel 108. For example, in embodiments where the end of the first panels 102 and the second panel 108 are curved such that a circular profile is formed, the fan shroud 162 may have a circular opening to allow for the fan guard 100 to couple to the fan shroud 162. As such, the fan guard 100 as described herein can be used for existing radiators as only the fan shroud 162 needs to be adjusted to fit the fan guard 100 onto the fan shroud 162.

Figure 11:
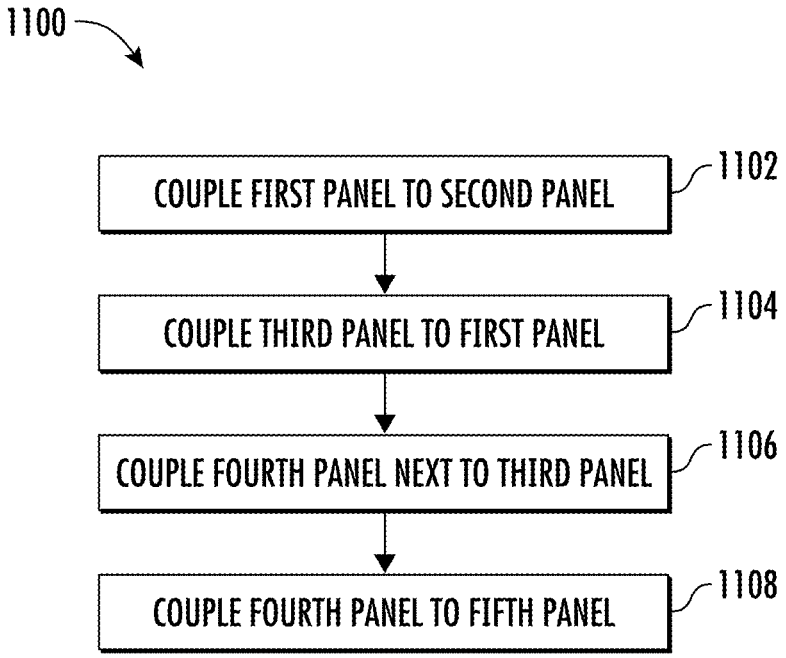
FIG. 11 depicts a process of assembling an exemplary fan guard.

FIG. 11 depicts a method 1100. The method 1100 can be used to assemble the fan guard 100. The method 1100 includes coupling a first panel to a second panel at step 1102. In various embodiments, the first panel and the second panel have a same configuration at the first panel 102. Step 1102 can include fixedly coupling the first panel and the second panel. For example, mechanical fasteners can be used to fixedly couple the first panel and the second panel. A first end of the first panel can be coupled to a second end of the second panel. In various embodiments, the first end and the second end include flanges, as described herein in relation to the first flange 114 and the second flange 116.

The method 1100 also includes coupling a third panel to the first panel at step 1104. In various embodiments, the third panel has a same configuration as the first panels 102. The third panel can be coupled to the first panel by coupling a second end of the first panel to a first end of the third panel. In various embodiments, the first panel is fixedly coupled to the third panel and mechanical fasteners are used.

The method 1100 includes positioned a fourth panel next to the third panel at step 1106. For example, a first end of the fourth panel can be positioned next to a second end of the third panel such that a gap exists between the fourth panel and the third panel. In various embodiments, the fourth panel has a same configuration as the second panel 108. The positioning of the fourth panel next to the third panel can aid in alleviating assembly stress from coupling the first panel, the second panel, and the third panel, among other panels.

The method 1100 includes coupling a fifth panel to the fourth panel at step 1108. For example, the fifth panel can be coupled to the fourth panel by coupling a second end of the fourth panel to a first end of the fifth panel. In various embodiments, the fifth panel is fixedly coupled to the fourth panel. The first end of the fifth panel can include the first flange 114 to couple to the second flange 116 positioned on the second end of the fourth panel.

In various embodiments, the fan guard 100 as described in the exemplary embodiment of the method 1100 can be fully enclosed by coupling the fifth panel to the second panel. For example, a second end of the fifth panel can be coupled to a first end of the second panel. In various embodiments the fifth panel is coupled to the second panel before the fourth panel is positioned next to the third panel at step 1106. This allows for the fourth panel to function as a final panel and reduce the tolerance stack up from the coupling of the other panels.

The method 1100 can also include coupling the ring 140 to the panels. For example, the first ring portion 142 can be coupled to the first panel, the second panel, and the third panel. The second ring portion 144 can be coupled to the fourth panel and the fifth panel. As described herein, this configuration of the ring 140 allows for the ring 140 to be removed or coupled to the fan without having to remove the fan from the engine.

Advantageously, the configuration of the fan guard 100 as described herein reduces a potential for damage or fatigue to the fan guard 100. Rather than a use of welding and wires that are typically seen in fan guards, the fan guard 100 uses panels that can be manufactured from steel and laser cut or stamped. The positioning of a gap between two of the panels allows for a reduction in assembly stress while increasing stiffness. Additionally, the usage of a ring with a first portion and a second portion increases stiffness while also ensuring ease in assembly of the fan guard 100. The fan guard 100 and the assembly of the fan guard 100 provides a fan guard for radiators with greater performance.

While this specification contains specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially," "generally," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the appended claims.

Unless otherwise indicated, all numbers expressing quantities of properties, parameters, conditions, and so forth, used in the specification and claims are to be understood as being modified in all instances by the terms "about" or "approximately." Accordingly, unless indicated to the contrary, the numerical parameters set forth in the following specification and attached claims are approximations. Any numerical parameter should at least be construed in light of the number reported significant digits and by applying ordinary rounding techniques. The terms "about" or "approximately" when used before a numerical designation, e.g., amount, including range, indicates approximations which may vary by (+) or (−) 10%, 5% or 1%.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the various systems shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the disclosure, the scope being defined by the claims that follow. When the language "a portion" is used, the item can include a portion and/or the entire item unless specifically stated to the contrary.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. A fan guard, comprising:

a plurality of first panels radially extending from a center of the fan guard, at least one of the first panels including a first panel first end radially extending from the center of the fan guard and a first panel second end radially extending from the center of the fan guard, the first panel first end of one of the first panels fixedly coupled to the first panel second end of another of the first panels; and a second panel radially extending from the center of the fan guard, the second panel including:

a second panel first end radially extending from the center of the fan guard, the second panel first end positioned next to the first panel second end of one of the first panels such that a gap is present between the one of the first panels and the second panel, the gap to vary based on the first panels, and a second panel second end radially extending from the center of the fan guard, the second panel second end fixedly coupled to the first panel first end of another one of the first panels, the first panels and the second panel including a plurality of openings.

2. The fan guard of claim 1, wherein the first panel first end of one of the first panels is fixedly coupled to the first panel second end of another of the first panels with mechanical fasteners and the second panel second end is fixedly coupled to the first panel first end of another one of the first panels with mechanical fasteners.

3. The fan guard of claim 1, wherein:

the first panels include a first flange positioned at the first panel first end and a second flange positioned at the first panel second end, the first panels fixedly coupled by the first flange and the second flange.

4. The fan guard of claim 3, wherein:

the second panel includes a third flange at the second panel first end and the second flange at the second panel second end, the third flange including a bent portion such that the gap between the one of the first panels and the second panel varies in size.

5. The fan guard of claim 1, wherein the plurality of openings are annular.

6. The fan guard of claim 1, wherein the first panels and the second panel have a top half and a bottom half defined by a center of the panels, a first row in the top half including a greater number of openings than a second row in the bottom half.

7. The fan guard of claim 1, wherein the openings are arranged radially along rows and spaced apart from adjacent openings by a predetermined distance.

8. The fan guard of claim 7, wherein the predetermined distance of the openings in a first row is greater than the distance of the openings in other rows, the first row having a greatest distance from the center of the fan guard.

9. The fan guard of claim 1, further comprising a ring having a first ring portion removably coupled to one or more of the first panels and a second ring portion removably coupled to another of the first panels.

10. The fan guard of claim 1, wherein an odd number of the first panels are provided.

11. The fan guard of claim 1, wherein the first panels and the second panel have an end coupled to the first end and the second end, the end being curved or linear in profile.

12. The fan guard of claim 1, further comprising a radiator, wherein the first panels and the second panel are coupled to the radiator by a fan shroud.

13. The fan guard of claim 12, wherein the shroud includes an opening complementary in profile to the coupled first panels and the second panel.

14. A fan guard, comprising:

a plurality of panels radially extending from a center of the fan guard, at least one of the panels including:

a first end radially extending from the center of the fan guard and including a first flange extending in a first direction orthogonal to a plane of the panels, a second end radially extending from the center of the fan guard and including a second flange extending in the first direction, and a plurality of openings extending through the panels, the openings arranged radially in rows; and wherein the first flange of one of the panels is positioned next to the second flange of an adjacent panel such that a gap exists between the two panels;

wherein the first flange of the remaining panels are fixedly coupled to the second flange of an adjacent panel, the gap to vary based on the remaining panels.

15. The fan guard of claim 14, further comprising a ring removably coupled to a first panel of the plurality of panels and a second panel of the plurality of panels.

16. The fan guard of claim 15, wherein the ring is proximate a center of the fan guard.

17. The fan guard of claim 15, wherein the ring includes a first ring portion removably coupled to the first panel and the second panel and a second ring portion removably coupled to another panel of the plurality of panels.

* * * * *